US011515110B2

(12) United States Patent
Korbel et al.

(10) Patent No.: US 11,515,110 B2
(45) Date of Patent: Nov. 29, 2022

(54) NOZZLE FOR HIGH OR MEDIUM VOLTAGE CIRCUIT BREAKER

(71) Applicant: Hitachi Energy Switzerland AG, Baden (CH)

(72) Inventors: Jakub Korbel, Baden (CH); Olaf Hunger, Schaffhausen (CH); Reto Karrer, Stäfa (CH); Henrik Dahlgren, Hanoi (VN); Alexey Sokolov, Baden (CH); Giang PhamVan, Hanoi (VN)

(73) Assignee: Hitachi Energy Switzerland AG, Baden (CH)

( * ) Notice: Subject to any disclaimer, the term of this patent is extended or adjusted under 35 U.S.C. 154(b) by 0 days.

(21) Appl. No.: 17/253,349

(22) PCT Filed: Aug. 28, 2019

(86) PCT No.: PCT/EP2019/072976
§ 371 (c)(1),
(2) Date: Dec. 17, 2020

(87) PCT Pub. No.: WO2020/043782
PCT Pub. Date: Mar. 5, 2020

(65) Prior Publication Data

US 2021/0265122 A1 Aug. 26, 2021

(30) Foreign Application Priority Data

Aug. 30, 2018 (EP) ..... 18191753

(51) Int. Cl.
*H01H 33/53* (2006.01)
*H01H 33/74* (2006.01)

(52) U.S. Cl.
CPC ..... *H01H 33/74* (2013.01); *H01H 33/53* (2013.01)

(58) Field of Classification Search
CPC ..... H01H 33/53; H01H 33/56; H01H 33/561; H01H 33/596; H01H 33/7023;
(Continued)

(56) References Cited

U.S. PATENT DOCUMENTS 4,665,289 A * 5/1987 Yanabu ..... H01H 33/901 218/65
5,977,502 A * 11/1999 Mizoguchi ..... H01H 33/901 218/43

(Continued)

FOREIGN PATENT DOCUMENTS

DE 102015205388 A1 9/2016
EP 0763250 B1 1/1998
JP S6182332 U 5/1986

OTHER PUBLICATIONS

Translation of DE102015205388 (Original document published Sep. 29, 2016) (Year: 2016).*

(Continued)

*Primary Examiner* — William A Bolton
(74) *Attorney, Agent, or Firm* — Sage Patent Group

(57) ABSTRACT

A gas-insulated high or medium voltage circuit breaker comprising: a first arcing contact and a second arcing contact, wherein at least one of the two arcing contact is axially movable along a switching axis, wherein during a breaking operation, an arc between the first arcing contact and the second arcing contact is formed in a arcing region; a buffer housing defining a pressurizing volume; a nozzle arranged at a nozzle side of the pressurizing volume, the nozzle defining a channel connected to the pressurizing volume and directed to the arcing region, for blowing an arc extinguishing gas towards the arcing region during the breaking operation, the nozzle comprising a nozzle front face facing towards the interior of the pressurizing volume.

19 Claims, 5 Drawing Sheets

(58) Field of Classification Search
CPC .. H01H 33/703; H01H 33/7038; H01H 33/74; H01H 33/70; H01H 33/98; H01H 2033/902; H01H 2033/908
USPC ..... 218/53, 57, 59, 60–63, 72
See application file for complete search history.

(56) References Cited

U.S. PATENT DOCUMENTS 6,040,970 A * 3/2000 Lehmann ..... H01H 33/7061 218/53
6,646,850 B1 * 11/2003 Bergmann ..... H01H 33/7015 218/53
7,619,177 B2 * 11/2009 Saxl ..... H01H 33/7061 218/63
8,115,133 B2 * 2/2012 Uchii ..... H01H 33/7076 218/63
9,543,095 B2 * 1/2017 Kaneko ..... H01H 33/91
2014/0190938 A1 * 7/2014 Tsukushi ..... H01H 33/91 218/63
2016/0133407 A1 5/2016 Nomura et al.

OTHER PUBLICATIONS

International Search Report and Written Opinion dated Nov. 15, 2019 for International Patent Application No. PCT/EP2019/072976, 14 pages.
Extended European Search Report dated Feb. 12, 2019 for European Patent Application No. 18191753.5, 7 pages.
Reiz, Robert, "Konstruktion eines Druckstoß Prufstandes für Isolierdüsen von Leistungsschaltern (Construction of a Pressure Surge Test Bench for Insulating Nozzles from Circuit Breakers)"; Hochschule Konstanz, University of Applied Sciences, Faculty of Mechanical Engineering; Baden, CH, Dec. 10, 2013, 195 pages (includes English machine-translation).

* cited by examiner

800

NOZZLE FOR HIGH OR MEDIUM VOLTAGE CIRCUIT BREAKER

CROSS-REFERENCE TO RELATED APPLICATIONS

This application is a 35 U.S.C. § 371 national stage application of PCT International Application No. PCT/EP2019/072976 filed on Aug. 28, 2019, which itself claims priority to European Patent Application No. 18191753.5 filed Aug. 30, 2018, the disclosures and contents of which are incorporated by reference herein in their entireties.

FIELD

Embodiments of the present disclosure relate generally to a gas-insulated high or medium voltage circuit breaker including a first arcing contact and a second arcing contact, wherein at least one of the two arcing contact is axially movable along a switching axis, wherein during a breaking operation, an arc between the first arcing contact and the second arcing contact is formed in a arcing region. The circuit breaker further includes a buffer housing defining a pressurizing volume.

BACKGROUND

Circuit breakers are well known in the field of medium and high voltage breaking applications. They are capable of being used for interrupting a current, when an electrical fault occurs. As an example, circuit breakers have the task of opening contacts and keeping them apart from one another in order to avoid a current flow even in case of high fault current and/or electrical potential originating from the electrical fault itself.

When interrupting the current flowing in the electrical circuit, an arc is generally generated. This arc is extinguished by quenching gas within the nozzle of the electrical circuit, such that the gap between the contacts repeatedly can withstand the voltage. Due to the high temperature of the arc high pressure pulses are generated by expansion of the quenching gas. Such pressure pulses can cause parts of the breaker to deform or even to destroy during breaking action.

Thus, there is a need for solutions to improve the operation of the circuit breaker, in particular of the nozzle, and/or the durability of the circuit breaker.

SUMMARY OF THE INVENTION

An object of the invention can be considered to provide an improved gas-insulated high or medium voltage circuit breaker which reduces the above mentioned problems occurring during power interruption.

In light of the above, a gas-insulated high or medium voltage circuit breaker according to claim 1 is provided. Aspects, benefits, and features of the present disclosure are apparent from the claims, the description, and the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments. The accompanying drawings relate to embodiments of the disclosure and are described in the following.

DETAILED DESCRIPTION OF EMBODIMENTS

Figure 1:
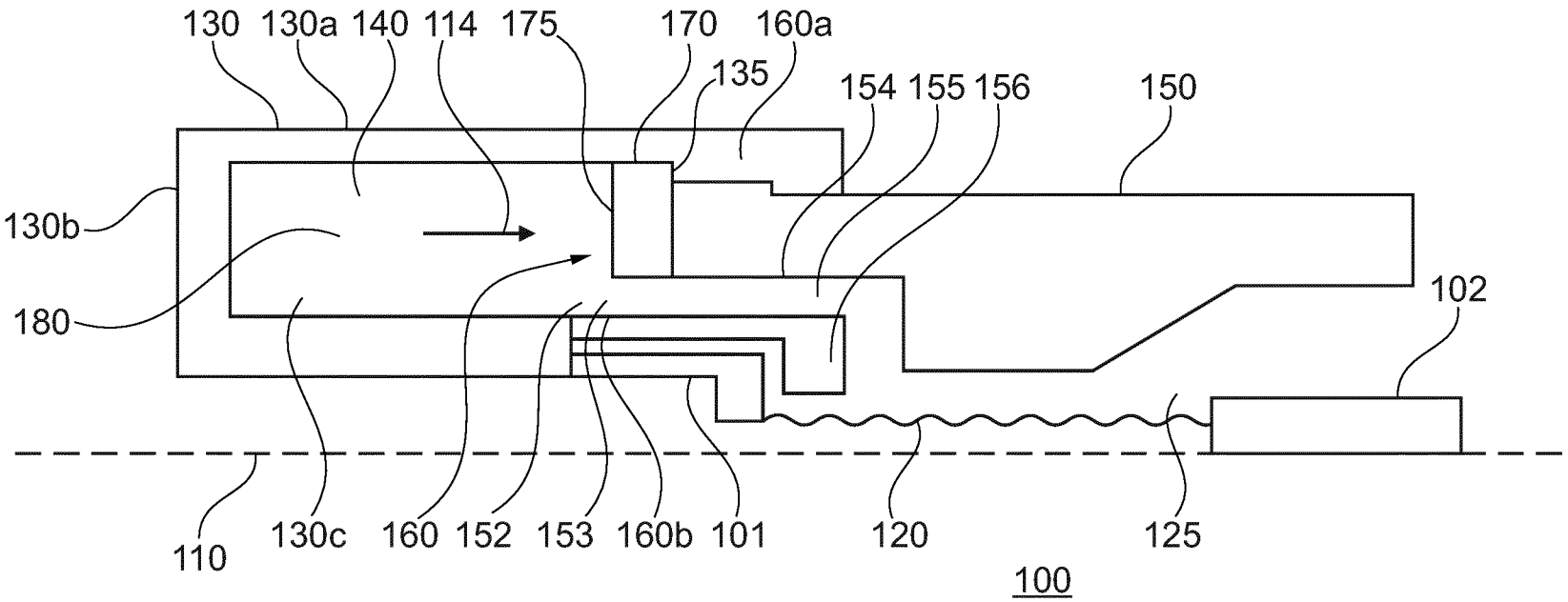
FIG. 1 schematically shows a section of a cross-sectional view of a gas-insulated high or medium circuit breaker according to a first embodiment described herein.

Reference will now be made in detail to the various embodiments of the disclosure, one or more examples of which are illustrated in the figures. Within the following description of the drawings, the same reference numbers refer to same components. Generally, only the differences with respect to individual embodiments are described. Each example is provided by way of explanation of the disclosure and is not meant as a limitation of the disclosure. Further, features illustrated or described as part of one embodiment can be used on or in conjunction with other embodiments to yield yet a further embodiment. It is intended that the description includes such modifications and variations.

The term circuit breaker generally refers to a gas-insulated high or medium circuit breaker. The circuit breaker may be a puffer type circuit breaker or a self-blast circuit breaker or a combination thereof.

With exemplary reference to FIGS. 1 to 7, embodiments of a gas-insulated high or medium voltage circuit breaker 100 according to the present disclosure is described. According to embodiments, which can be combined with other embodiments described herein, the gas-insulated high or medium voltage circuit breaker 100 includes a first arcing contact 101 and a second arcing contact 102, wherein at least one of the two arcing contact is axially movable along a switching axis 110, wherein during a breaking operation, an arc 120 between the first arcing contact 101 and the second arcing contact 102 is formed in a arcing region 125; a buffer housing 130 defining a pressurizing volume 140; a nozzle 150 arranged at a nozzle side 152 of the pressurizing volume 140, the nozzle 150 defining a channel 155 connected to the pressurizing volume 140 and directed to the arcing region 125, for blowing an arc extinguishing gas towards the arcing region during the breaking operation, the nozzle 150 comprising a nozzle front face 160 facing towards the interior of the pressurizing volume 140; a shielding body 170 arranged between the pressurizing volume 140 and the nozzle 150, the shielding body 170 being supported by the buffer housing 130, wherein the shielding body 170 comprises a shielding surface 175 exposed to the interior 180 of the pressurizing volume 140, and wherein the shielding body 170 covers a major portion of the nozzle front face 160.

FIG. 1 shows a schematic sectional view of an exemplary embodiment of a circuit breaker 100 as described above. The circuit breaker 100 includes a metallic buffer housing 130 which encloses pressurizing volume 140, which has a cuboid shape in cross sectional view. The puffer housing 130 encloses the cuboid-shaped pressurizing volume 140 from an upper side by an upper buffer housing 130*a*, from a lower side by a lower buffer housing 130*c* and from a compression side 130*b*. The fourth side of cuboid-shaped pressurizing volume 140 is defined as the nozzle side 152, which is opposite to the compression side 130*b*. On the nozzle side 152 the pressurizing volume 140 is delimited by the nozzle front face 160*b* and a shielding surface 175 of a sealing plate 170. The plate 170 is arranged adjacent to the nozzle front face 160*a*, wherein the sealing plate 170 covers the nozzle front face 160*a*. The shielding body 170 includes a shielding surface 175 exposed to the interior 180 of the pressurizing volume 140.

Furthermore, the nozzle 150 forms a channel 155 which connects the interior 180 of the pressurizing volume 140 at an channel opening 153 with an arcing region 125. On the nozzle side 152 the channel 155 is formed by an upper part 154 of the nozzle 150 and a lower part 156 of the nozzle 150. In case an arc 120 is generated in the arcing region 125 between the first arcing contact 101 and the second arcing contact 102 during a breaking operation of the circuit breaker 100, the gas within the arcing region 125 is instantaneously heated by the generated arc 120. The temperature of the electrical arc 120 can reach up to 20000° K, which leads to high pressures pulses caused by the heated gas within the arcing region 125. The pressure pulses expands through the channel 155 into the interior 180 of the pressurizing volume 140. The expanded gas within the pressurizing volume 140 generates a pressure which exert a force in axial direction 114 towards the nozzle side 152.

The pressure directed in axial direction 114 towards the nozzle side 152 acts on the shielding surface 175, wherein the pressure can be absorbed by the sealing plate 170 which is supported by the buffer housing 130. As follows: the sealing plate 170 is abutted against a stop 135 provided at the buffer housing 130*a* towards the nozzle front side. Thereby, the sealing plate 170 can reduce an axial load directed towards the axial direction 114 acting on the nozzle 150. Furthermore, at the stop 135 the nozzle 150 is sealed in axial direction. The nozzle 150 is made of PTFE (polytetrafluorethylene) material by which the sublimation properties of the nozzle 150 can be improved for generating PTFE vapor to cool down the arc and to interrupt the arc.

In contrast, if the sealing plate would be omitted or reduced in site so that, it would no longer cover a major portion of nozzle font face, the nozzle would be highly affected to the pressure exerting from the interior 180 of the pressurizing volume 140 towards the nozzle side 152. Due to the higher rigidity of the metallic sealing plate 170 and the metallic puffer housing 140 in comparison with the nozzle 150 made of PTFE the circuit breaker 100 is more resistant to pressures caused by arcs.

Figure 2:
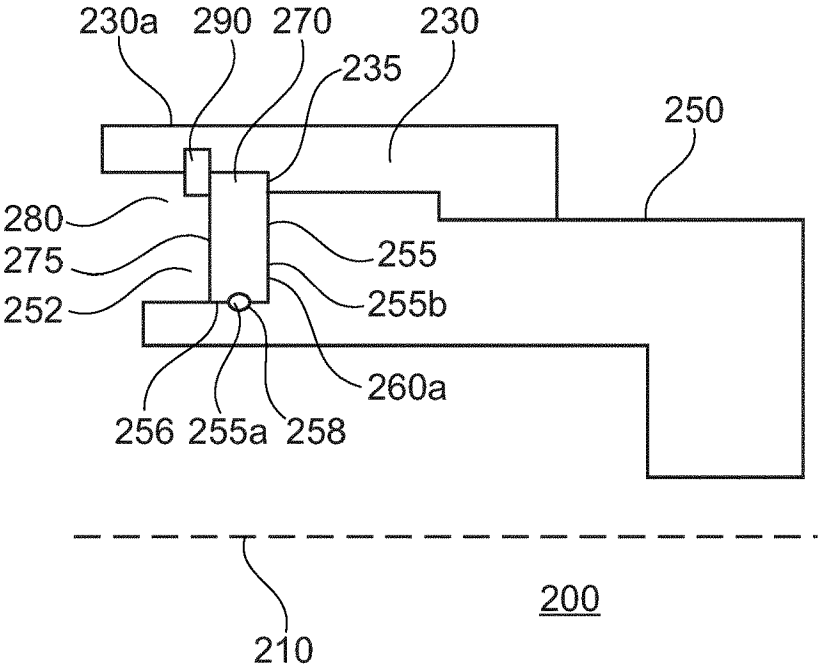
FIG. 2 schematically shows a section of a cross-sectional view of a gas-insulated high or medium circuit breaker including an O-ring at bottom of the sealing plate according to a second embodiments described herein.

A schematic cross-sectional side view of a further embodiment of a gas-insulated high or medium circuit breaker is given in FIG. 2. The circuit breaker 200 includes a sealing plate 270 which is arranged on the nozzle side 252. The sealing plate 270 is adjacent to the nozzle front face 260*a* wherein a gap area 255 is formed between the nozzle front face 260*a* and the sealing plate 270. The gap area 255 is connected to the interior 280 of the pressurizing volume by a gap area opening 256. The gap area 255 includes an anterior section 255*a* and a posterior section 255*b* wherein the anterior section 255*a* is closer to the gap area opening 256 than the posterior section 255*b*. An O-ring 258 is arranged in the anterior section 255*a* of the gap area 255. The O-ring 258 locks, in particular seals the gap area 255, whereby a penetration of pressure coming from the interior 280 through the gap area opening 256 can be prevented. The O-ring 258 arranged in the anterior section 255*a* can enhance the circumferential tightness. The anterior section 255*a* runs essentially parallel with the switching axis 210 wherein the posterior section 255*b* runs essentially perpendicular to the anterior section 255*a* and the switching axis 210.

The sealing plate 270 is abutted against a stop 235 provided at the buffer housing 230*a* towards the nozzle front side. At the side of the shielding surface 275 the sealing plate 270 is fixed by a retaining ring 290 arranged at the buffer housing 230*a*. The sealing plate 270 can resists pressure exerting on the shielding surface 275 by being abutted against the stop 235.

Figure 3:
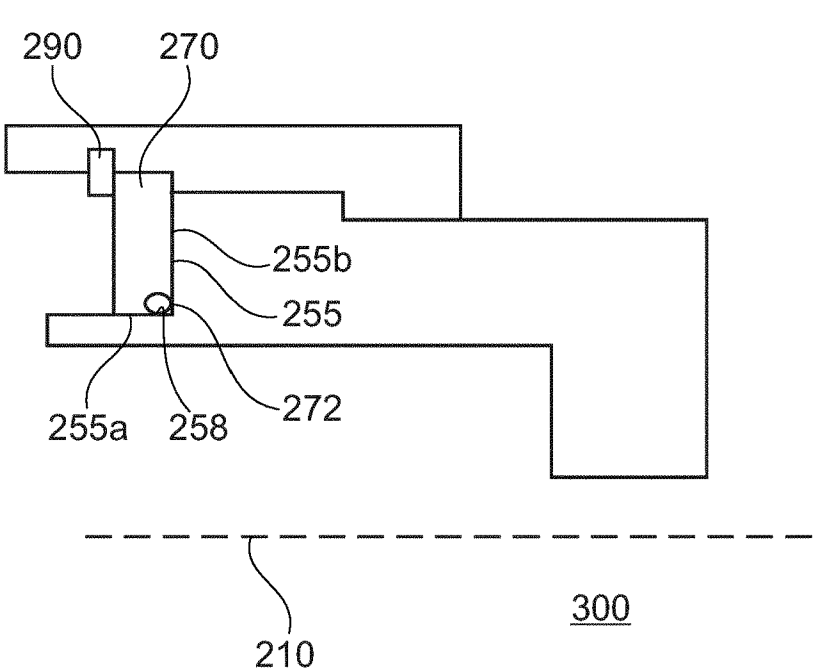
FIG. 3 schematically shows a section of a cross-sectional view of a gas-insulated high or medium circuit breaker including a corner sealing arrangement according to a third embodiments described herein.

FIG. 3 shows a further embodiments of a gas-insulated high or medium circuit breaker 300 having the same design, as the embodiment of the circuit breaker 200 shown in FIG. 2, except to the following: In the embodiment shown in FIG. 3 the O-ring 258 is arranged within the gap area 255 between the anterior section 255*a* and the anterior section 255*b*. In particular, the O-ring 255 is positioned at the intersection where the anterior section 255*a* merges into the posterior section 255*b*. The position of the O-ring can also be described as a corner section 272 of the sealing plate 270. The O-ring 255 is arranged at the position of the gap area 255 where the gap area 255 bends from the horizontal extending anterior section 255*a* into the vertical extending posterior section 255*b*. By arranging the O-ring 258 at the intersection of the anterior section 255*a* and the posterior section 255*b* an axial tightness and a circumferential tightness can be provided simultaneously.

Figure 4:
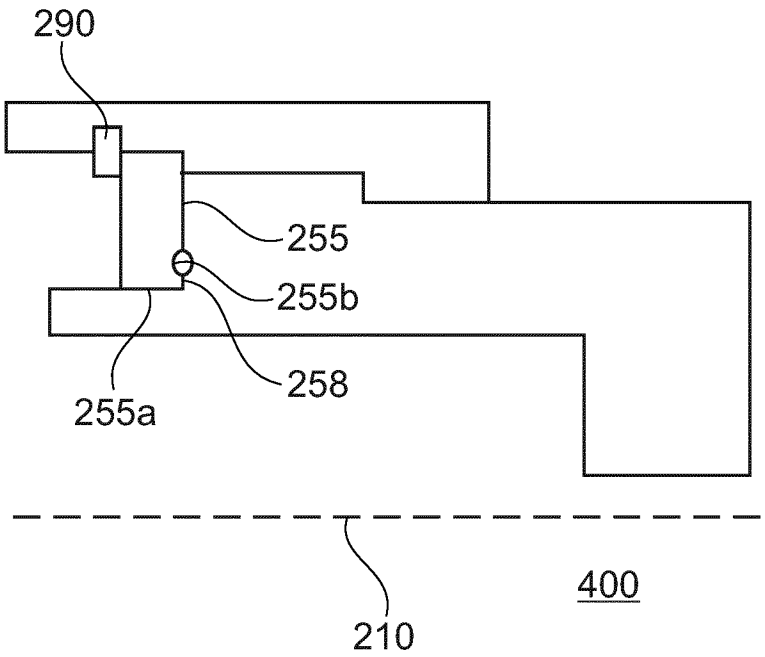
FIG. 4 schematically shows a section of a cross-sectional view of a gas-insulated high or medium circuit breaker including an O-ring according to a fourth embodiments described herein.

FIG. 4 shows a further embodiment of a gas-insulated high or medium circuit breaker 400 having the same design as the embodiments shown in FIG. 2 and FIG. 3. In the embodiment of FIG. 4 the O-ring 258 is arranged in the posterior section 255*b* of the gap area 255. By arranging the O-ring 258 in the posterior section 255*b* the tightness in axial direction can be improved.

Figure 5:
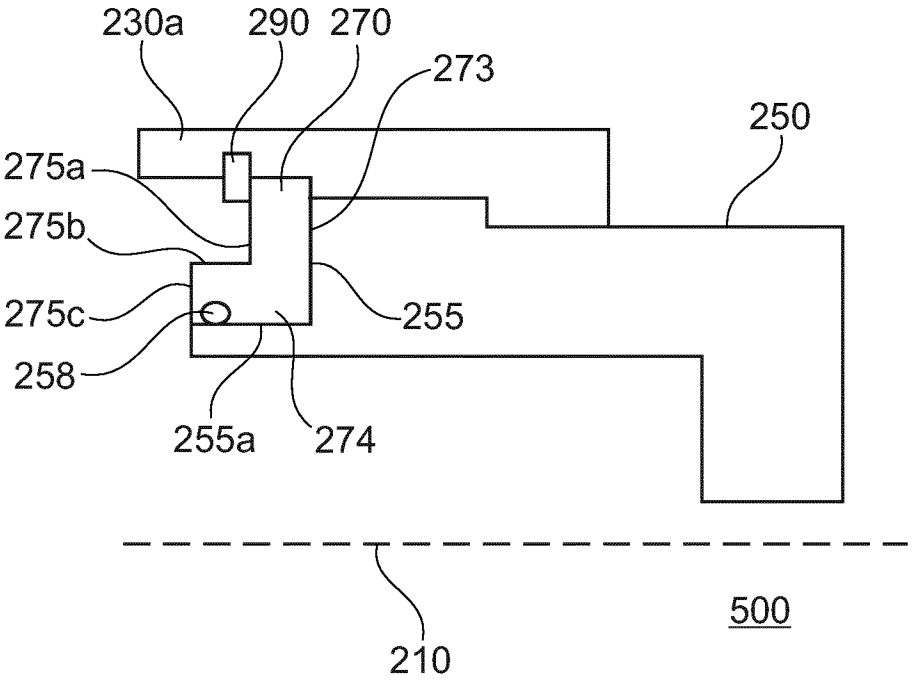
FIG. 5 schematically shows a section of a cross-sectional view of a gas-insulated high or medium circuit breaker including an L-shaped sealing plate according to a fifth embodiments described herein.

FIG. 5 shows a further embodiment of a gas insulated high or medium circuit breaker 500 wherein the sealing plate 270 has L-shaped cross-section. The sealing plate 270 includes a long leg section 273 and a short leg section 274 which are perpendicular to each other. The L-shaped sealing plate 270 forms an upper shielding surface 275*a*, a middle shielding surface 275*b* and a lower shielding surface 275*c*. The upper shielding surface 275*a* and the lower shielding surface 275*c* run parallel to each other, wherein the middle shielding surface 275*b* runs perpendicular to the both other shielding surfaces 275*a* and 275*b*. An O-ring 258 is arranged in the anterior section 255*a* of the gap area 255 as described in the embodiment shown in FIG. 2. At the upper shielding surface 275*a* of the sealing plate 270 is fixed by a retaining ring 290 arranged at the buffer housing 230*a*. The L-shaped cross section of the sealing plate 270 provides a high stability to the circuit breaker 500, wherein due to leg sections 273 and 274 the nozzle 250 can be stabilized and protected in axial direction and in circumferential direction.

Figure 6:
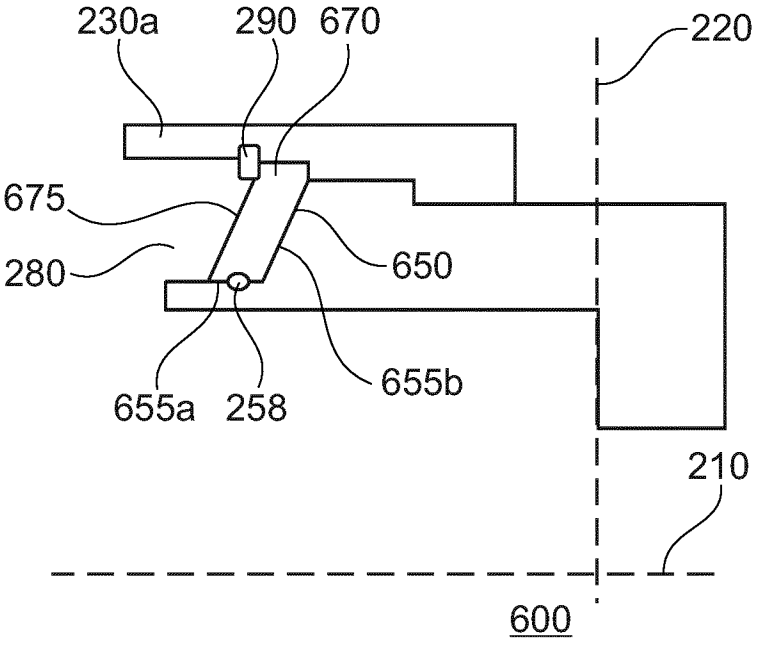
FIG. 6 schematically shows a section of a cross-sectional view of a gas-insulated high or medium circuit breaker including a tilted sealing plate according to a sixth embodiments described herein.

FIG. 6 shows a further embodiment of a circuit breaker 600 including a sealing plate 670 having a tilted, conical cross section. The sealing plate 670 includes a tilted shielding surface 675 which is inclined with respect to the vertical axis 220. Thus, the sealing plate 670 forms therefore a tilted shielding surface 675 towards the interior 280 of the pressurizing volume. The sealing plate 670 has a parallelepiped-form, wherein the posterior section 255*b* of the gap area 255 runs in parallel to the tilted shielding surface 675. By forming a tilted surface with the interior 280 of the pressurizing volume the sealing plate 675 can direct a pressure pulse impacting the tilted shielding surface 675 from the interior 280 of the pressurizing volume more easily upwards the buffer housing 230*a*.

Figure 7:
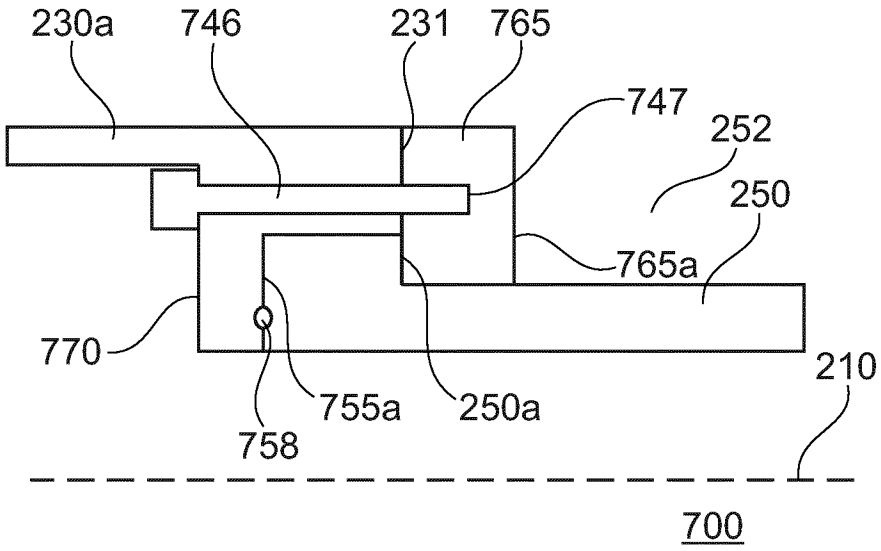
FIG. 7 schematically shows a section of a cross-sectional view of a gas-insulated high or medium circuit breaker including a puffer tip according to a seventh embodiments described herein.

FIG. 7 shows a further embodiment of a circuit breaker 700, wherein the sealing plate 770 is integrated within the buffer housing 230*a*. The nozzle 250 is arranged adjacent to sealing plate 270. The sealing plate 270 forming an anterior section 755*a* of a gap area 755 which runs perpendicular to the switching axis 210. An O-ring 758 is inserted in the anterior section 755*a* for sealing the anterior section 755*a* towards the pressurizing volume. The nozzle 250 is clamped by a puffer tip 765 mounted on a screw section 746 which is arranged at the buffer housing 230*a*. The screw section 745 is inserted in the housing 230*a*, in particular inserted in the sealing plate 770 of the buffer housing 230*a*, from the side of the pressurizing volume.

The screw section 746 penetrates the buffer housing 230*a* wherein a screw section tip 747 protrudes out of the buffer housing 230*a* at the nozzle side 252. The puffer tip 765 is attached on the screw section tip 747, wherein the puffer tip 765 and the screw section tip 747 is mutually fixed via a thread.

On the upper part of the nozzle 250 the nozzle 250 includes an abutment surface 250*a* which is covered by a lower part 765*a* of the puffer tip 765. The nozzle 250 is thereby clamped between the sealing plate 770 and the puffer tip 765 pressing with the lower part of the buffer tip 765*a* on the nozzle abutment surface 250*a*. The puffer tip 765 is further pressed against a stop surface 231 arranged at the buffer housing 230*a*.

Furthermore, the design of the circuit breaker 700 according to the embodiment shown in FIG. 7, enables to assemble the nozzle 250 from the nozzle side 252. The nozzle 250 is placed on the sealing plate 770 and fixed by the screw section 746 and the puffer tip 765 as described therein.

Figure 8:
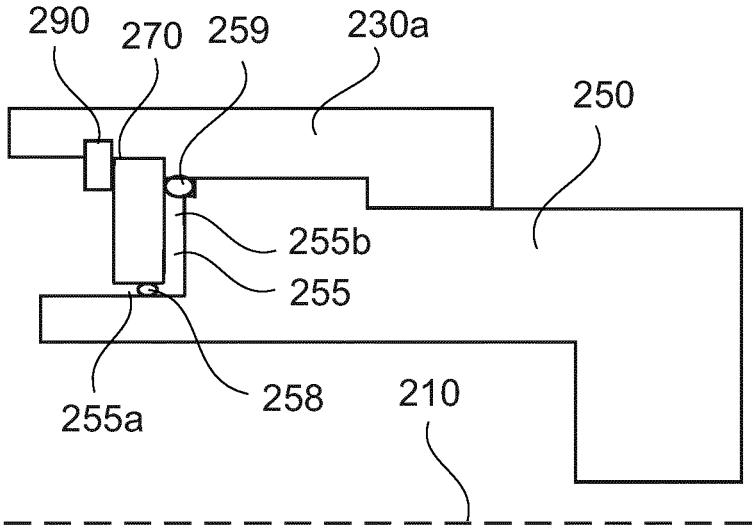
FIG. 8 schematically shows a section of a cross-sectional view of a gas-insulated high or medium circuit breaker including an O-ring and a further O-ring according to an eights embodiments described herein.

FIG. 8 shows a further embodiment of a gas-insulated high or medium circuit breaker 800 having the same design as the embodiments shown in FIG. 4. In the embodiment of FIG. 8 the O-ring 258 is arranged in the anterior section 255*a* of the gap area 255, wherein the gap area 255 is shown enlarged. By arranging the O-ring 258 in the anterior section 255*a* the circumferential tightness can be enhanced. A further O-ring 259 is arranged at the end of the posterior section 255*b* of the channel 255 between the sealing plate 270, the nozzle 250 and the housing 230*a* to seal the nozzle 250 with respect to the housing 230*a*, in particular to seal the outer diameter of the nozzle 250 against the housing 230*a*.

The term "buffer housing" can be understood as an enclosure, which defines the pressurizing volume, for example by means of walls or sidewalls or the like. The buffer housing can include or form openings or apertures to connect the interior of the pressurizing volume with other parts of the circuit breaker. The buffer housing can define any three dimensional interior of the pressurizing volume, for example a cuboid, a cube-shaped, a cylindrical interior or the like. The puffer housing can be have a rigid, solid, and/or inflexible form which enables to sustain high pressure, in particular high pressure pulses exerting from the interior of the pressurizing volume to the buffer housing.

In particular, the buffer housing can have a higher sturdiness, rigidity and/or a higher tensile strength against pressure and/or deformation than the nozzle. The buffer housing can, for example, include materials such like metal, metal alloys, such as steel, or carbon compounds. Furthermore, the buffer housing can be part of or can be connected to a compression chamber, for example by means of an opening or a valve.

The term "pressurizing volume" can be understood as a gas-filled volume which is under pressure or can be pressurized. The pressure within the gas-filled volume can be changed from outside, for example, by reducing or increasing the pressurizing volume. The term pressurizing volume can also be understood as a heating volume if a self-blast circuit breaker is used. Furthermore, the term pressurizing volume can be understood as the buffer volume of a buffer-type circuit breaker. The pressurizing volume can be filled with a dielectric medium, in a particular a dialectic insulation gas.

The term "nozzle" can be understood as a nozzle system within which gas can be exchanged between individual parts of the nozzle. In particular, the nozzle enables a gas-flow or a gas exchange between the pressurizing volume and the arcing region through a channel. The channel can be formed between two parts of the nozzle facing each other. The nozzle side of the pressurizing volume can be understood as the side of the pressurizing volume at which the nozzle is arranged to. In particular, the nozzle side can be understood as the side which is next to the pressurizing volume towards the second arcing contact along the switching axis.

The term "nozzle front face" can be understood as all sides of the nozzle which faces towards the interior of the pressurizing volume both in an axial direction and in a radial direction. The nozzle front side can include openings or apertures by which the interior of the pressurizing volume is connected to the nozzle, in particular by which a gas-flow or a gas exchange between the pressurizing volume and the arcing region can be passed through.

The term "shielding body" can be understood as, e.g., a plate-like rigid component, in particular as a sealing plate, which is arranged between the nozzle and the pressurizing volume. The shielding body has a higher rigidity and/or a higher stability and/or a higher shear strength than the nozzle. The shielding body is supported by the buffer housing. The term "supporting" can include, for example, attaching, welding, screwing together, and/or gluing or the like. The shielding body can form a stable and rigid connection with the buffer housing.

The shielding surface exposed to the interior of the pressurizing volume can form a pressure absorbing surface, which can take or absorb pressure where due to the support on the buffer housing a displacement or a deformation of the nozzle can be prevented. In particular, by covering the nozzle front face the shielding body can protect the nozzle front face from an overpressure within the pressurizing volume caused by an instantaneous expansion of the gas in case of an electrical arc generated during a breaking operation. Furthermore, the shielding body can also include one or more openings which are aligned with the channel defined by the nozzle.

Therein the term "a major portion" can be understood such that the shielding body covers at least 50%, in particular at least 75%, or more particularly over 90% by the area of the total nozzle front face.

Next general aspect of the invention are described, which can be combined with other aspects or embodiments described thereof. The term high or medium voltage relates to voltages that exceeds 1 kV. According to embodiments described herein, the circuit breaker is a gas-insulated circuit breaker adapted to interrupt medium to high-voltages of 12 kV or more, 52 kV or more, or 145 kV or more.

A high voltage preferably concerns nominal voltages in the range from 72 kV to 550 kV, like 145 kV, 245 kV or 420 kV. Nominal currents of the circuit breaker can be preferably in the range from 1 kA to 5 kA. The current which flows during the abnormal conditions in which the circuit breaker performs its duty may be interchangeably referred to as the breaking current or the short circuit current. The short circuit current may be in the range from 31.5 kA to 80 kA, which is termed high short-circuit current duty. In low short-circuit current duties, the breaking current is typically larger than the nominal current and smaller than 0.3 times the rated short-circuit current, e.g. at most 24 kA. During a breaking operation, breaking voltages may be very high, e.g. in the range from 110 kV to 1200 kV.

According to embodiments which can be combined with other embodiments described herein, the shielding surface is greater than the nozzle front face by area. A shielding surface being greater than the nozzle front surface can enhance the pressure absorbing capabilities of the shielding body. The shielding surface of the shielding body can also be curved, or stepped.

According to embodiments which can be combined with other embodiments described herein, a cross-sectional projection of the shielding surface in a cross-sectional plane perpendicular to the switching axis is larger than 50% of a cross-sectional projection of the nozzle front face. In particular, the cross-sectional projection of the shielding surface in a cross-sectional plane perpendicular to the switching axis can be larger than 75%, or more particularly larger than 90% of the cross-sectional projection of the nozzle front face. Thereby, the capability of the shielding body for absorbing pressure, in particular, for the pressure being directed in axial direction towards the nozzle side can be improved.

According to embodiments which can be combined with other embodiments described herein, the shielding body is supported by abutting, in axial direction against a stop of the buffer housing. The stop can be understood as a supporting surface or a bearing surface of the buffer housing, wherein the shielding body can be abutted in axial direction, in particular in direction of the nozzle side. The stop can also be understood as a groove or a recess arranged on the buffer housing wherein the shielding body can be at least partly inserted into.

According to embodiments which can be combined with other embodiments described herein, the shielding body is further supported by a retaining ring. The retaining ring can facilitate the attachment or the fixing of the shielding body at the buffer housing. The fixing effect caused by the retaining ring can also be understood as a clamping effect. The retaining ring supports the shielding body in a direction away from the nozzle side against the buffer housing. Further, it is also possible to use more than one retaining ring.

An alternative solution to improve the operation of the circuit breaker as described herein can be provided by a shielding body which is integrated with the buffer housing. The embodiment of a shielding body which is integrated with the buffer housing can also be combined with other embodiments described herein. The shielding body can be a part of the buffer housing, wherein the assembly of the circuit breaker can be facilitated since the shielding body no longer needs to be installed separately. The shielding body can be made of the same material as the buffer housing. Furthermore, the buffer housing including the sealing body can also be in one piece.

According to embodiments which can be combined with other embodiments described herein, the nozzle is supported against at least one further stop of the buffer housing by a buffer tip. The nozzle can be clamped between the buffer tip and the buffer housing, in particular between the buffer tip and the shielding body. The buffer tip can be, for example, understood as a plate-like fastener including a thread which can be fixed on a threading device arranged on the buffer housing. The Use of the buffer tip as described herein can improve the assembling process of nozzle within the circuit breaker. Furthermore, the stability of the nozzle within the circuit breaker can be enhanced.

According to embodiments which can be combined with other embodiments described herein, the shielding body protrudes inwardly from the buffer housing. Thus a shielding body having a higher thickness can be used. The shielding body can also reduce the pressurizing volume for adapting the pressurizing volume if necessary. In particular, when the pressurizing volume is used as a compression chamber.

According to embodiments which can be combined with other embodiments described herein, the shielding surface of the shielding body is at least partly essentially perpendicular to the switching axis. The term "essentially perpendicular to the switching axis" can be understood particularly when referring to the orientation of the shielding surface, to allow for a deviation from the vertical direction or orientation of +/−20° or below, e.g. +/−10° below. In particular, the shielding body can have sections in which the shielding surface is oriented essentially perpendicular to the switching axis whereby pressure from the interior of the pressurizing volume towards the nozzle side can be absorbed more easily.

According to embodiments which can be combined with other embodiments described herein, the shielding surface of the shielding body is at least partly tilted in relation to the vertical axis of the switching axis.

According to embodiments which can be combined with other embodiments described herein, the shielding body has L-shaped cross-section. L-shaped cross-section can be understood such as the shielding body has a long-leg section and a short-leg section, wherein the long leg section is longer than the short-leg-section. Furthermore, the term "cross section" can refer to a cross-sectional plane containing the switching axis. The long-leg section and the short-leg-section are essentially perpendicular with respect to each other. L-shaped cross section can provide a high stability against deformation. In particular, the parts of the nozzle front face which are oriented in parallel to the switching axis can be better protected against pressure.

According to embodiments which can be combined with other embodiments described herein, a pressure seal is provided within the space between the shielding body and the nozzle. The space can be understood as a slit area or gap area which is delimited by the nozzle, in particular by the nozzle front face and by the shielding area. The space can also be formed between a nozzle channel and the shielding area. The space includes an opening directed to the interior of the pressurizing volume between the shielding body and the nozzle, in which gas or a gas-flow of the pressurized volume can enter. In case of high pressure within the pressurized volume, the pressure seal can reduce the pressure exerting on the nozzle front face within the space or even prevent the pressure to penetrate the space.

There can be more than one pressure seal provided within the space. The pressure seal can also be understood as sealing element configured to seal the space towards the interior of the pressurizing volume. The pressure seal can include, for example, a foil element, solidified foam, a resin or the like. The pressure seal can also be heat resistant. The pressure seal can also be configured to provide an airtight closure within the space. Furthermore, the pressure seal can be glued to the shielding body and/or to the nozzle front face within the space between the shielding body and the nozzle.

According to embodiments which can be combined with other embodiments described herein, the pressure seal is arranged in an anterior section of the space between the shielding body and the nozzle. The space between the shielding body and the nozzle can be separated in at least to sections wherein one section can be the "anterior section" of the space and a further section can be the posterior section of the space between the shielding body and the nozzle. The term "anterior section" can be understood as the on section of two sections which is closer to the nozzle channel or the pressurizing volume than to the buffer housing. The orientation of the anterior section is different to the orientation of the posterior section. In particular, the anterior section can run essentially parallel to switching axis. The posterior section can run essentially perpendicular to the switching axis. The anterior section and the posterior section merge into one another, respectively. The pressure seal can also be arranged directly at the opening of the space to seal the opening to the interior of the pressurizing volume, in particular to close the space in flush with the buffer housing, the nozzle and/or the sealing plate.

According to embodiments which can be combined with other embodiments described herein, the pressure seal is an O-ring. By means of an O-ring the space can be sealed in an easy manner. The O-ring can include various materials such as rubber, perfluorocarbon rubber, polyethylene or polytetrafluorethylene (PTFE) or the like.

According to embodiments which can be combined with other embodiments described herein, the nozzle includes a fluoropolymer, in particular a filled or unfilled fluoropolymer, such as PTFE, TFM, PVDF, and the buffer housing includes a metal, and/or the shielding body includes material, which has higher stiffness or strength than the material of the nozzle. By using PTFE material for the nozzle the sublimation properties can be improved for generating PTFE vapor to cool down the arc and to interrupt the arc. The use of metal for the buffer housing can provide a high form stability which is provided also for the shielding body due to supporting the shielding body by the buffer housing. The high form stability of the buffer housing and/or of the shielding body can protect the nozzle from high pressure extending from the pressurized volume and/or from the channel due to a formed arc during a breaking operation.

According to embodiments, which can be combined with other embodiments described herein, the gas-insulated high or medium voltage circuit breaker is one of a puffer-type circuit breaker, a self-blast circuit breaker or a combination thereof. In embodiments, the gas blasted by the gas blast system is any suitable gas that enables to adequately extinguish the electric arc formed between the arcing contacts during current interruption operation, such as, but not limited, to an inert gas, for example, Sulphur hexafluoride $SF_6$. Thereby, the arc between the first and the second arcing contact develops in an arcing region.

For the purpose of this disclosure the dielectric medium used in the circuit breaker can be $SF_6$, carbon or dioxide or any other dielectric insulation medium, and in particular can be a dielectric insulation gas or arc quenching gas. Such dielectric insulation medium can for example encompass media comprising an organofluorine compound, such organofluorine compound being selected from the group consisting of: a fluoroether, an oxirane, a fluoroamine, a fluoroketone, a fluoroolefin, a fluoronitrile, and mixtures and/or decomposition products thereof.

This written description uses examples to disclose the invention, including the best mode, and also to enable any person skilled in the art to practice the invention, including making and using any devices or systems and performing any incorporated methods. While various specific embodiments have been disclosed in the foregoing, those skilled in the art will recognize that there are equally effective modifications. Especially, mutually non-exclusive features of the embodiments described above may be combined with each other. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A gas-insulated high or medium voltage circuit breaker comprising:

a first arcing contact and a second arcing contact, wherein at least one of the two arcing contact is axially movable along a switching axis, an arc between the first arcing contact and the second arcing contact being formed in an arcing region during a breaking operation;

a buffer housing defining a pressurizing volume;

a nozzle arranged at a nozzle side of the pressurizing volume, the nozzle defining a channel connected to the pressurizing volume and directed to the arcing region, the nozzle configured to blow an arc extinguishing gas towards the arcing region during the breaking operation, the nozzle comprising:

an anterior section extending essentially parallel to the switching axis; and a posterior section comprising a nozzle front face facing towards an interior of the pressurizing volume, the anterior section and the posterior section defining a gap area that is separated from the channel by the anterior section; and a shielding body arranged between the pressurizing volume and the nozzle within the gap area, the shielding body being supported by the buffer housing, the shielding body having a shielding surface exposed to the interior of the pressurizing volume, the shielding body covering a major portion of the nozzle front face, the shielding body not extending into the channel defined by the nozzle, the shielding body separated from the channel by the anterior section, and the shielding body being supported by abutting against a stop of the buffer housing, and the nozzle being sealed in an axial direction at the stop.

2. The gas-insulated high or medium voltage circuit breaker according to claim 1, wherein an area of the shielding surface is greater than an area of the nozzle front face.

3. The gas-insulated high or medium voltage circuit breaker according to claim 1, wherein a cross-sectional projection of the shielding surface in a cross-sectional plane perpendicular to the switching axis is larger than 50% of a cross-sectional projection of the nozzle front face.

4. The gas-insulated high or medium voltage circuit breaker according to claim 1, wherein the shielding body is further supported by a retaining ring arranged around the switching axis.

5. The gas-insulated high or medium voltage circuit breaker according to claim 1, wherein the nozzle is supported against at least one further stop of the buffer housing by a buffer tip.

6. The gas-insulated high or medium voltage circuit breaker according to claim 1, wherein the shielding body protrudes radially inwardly from the buffer housing.

7. The gas-insulated high or medium voltage circuit breaker according to claim 1, wherein the shielding surface of the shielding body is at least partly essentially perpendicular to the switching axis.

8. The gas-insulated high or medium voltage circuit breaker according to claim 1, wherein the shielding surface of the shielding body is at least partly tilted in relation to the vertical axis of the switching axis.

9. The gas-insulated high or medium voltage circuit breaker according to claim 1, wherein the nozzle comprises a fluoropolymer.

10. The gas-insulated high or medium voltage circuit breaker according to claim 9, wherein the fluoropolymer comprises at least one of PTFE, TFM, and PVDF.

11. The gas-insulated high or medium voltage circuit breaker according to claim 9, wherein the buffer housing comprises a metal.

12. The gas-insulated high or medium voltage circuit breaker according to claim 9, wherein a material of the shielding body has a higher stiffness or strength than a material of the nozzle.

13. The gas-insulated high or medium voltage circuit breaker according to claim 1, wherein the anterior section and the shielding body define a second gap area that is separated from the channel by the anterior section.

14. The gas-insulated high or medium voltage circuit breaker according to claim 1, wherein the shielding body has L-shaped cross-section having a long leg section perpendicular to the switching axis and a short leg section parallel to the switching axis, the shielding surface comprising:

an upper shielding surface defined by the long leg section;

a middle shielding surface defined by the short leg section, the middle shielding surface perpendicular to the upper shielding surface; and a lower shielding surface defined by the short leg section, wherein the upper shielding surface, the middle shielding surface, and the lower shielding surface are exposed to the interior of the pressurizing volume.

15. The gas-insulated high or medium voltage circuit breaker according to claim 1, wherein a pressure seal is provided within a space between the shielding body and the nozzle.

16. The gas-insulated high or medium voltage circuit breaker according to claim 15, wherein the pressure seal is arranged in an anterior section of the space between the shielding body and the nozzle.

17. The gas-insulated high or medium voltage circuit breaker according to claim 15, wherein the pressure seal is an O-ring.

18. A gas-insulated high or medium voltage circuit breaker comprising:

a first arcing contact and a second arcing contact, wherein at least one of the two arcing contact is axially movable along a switching axis, an arc between the first arcing contact and the second arcing contact being formed in an arcing region during a breaking operation;

a buffer housing defining a pressurizing volume;

a nozzle arranged at a nozzle side of the pressurizing volume, the nozzle defining a channel connected to the pressurizing volume and directed to the arcing region, the nozzle configured to blow an arc extinguishing gas towards the arcing region during the breaking operation, the nozzle comprising a nozzle front face facing towards an interior of the pressurizing volume; and a shielding body arranged between the pressurizing volume and the nozzle, the shielding body being supported by the buffer housing, the shielding body having a shielding surface exposed to the interior of the pressurizing volume, the shielding body covering a major portion of the nozzle front face, the shielding surface of the shielding body is at least partly tilted in relation to the vertical axis of the switching axis, and the shielding body being supported by abutting against a stop of the buffer housing, and the stop the nozzle being sealed in axial direction.

19. A gas-insulated high or medium voltage circuit breaker comprising:

a first arcing contact and a second arcing contact, wherein at least one of the two arcing contact is axially movable along a switching axis, an arc between the first arcing contact and the second arcing contact being formed in an arcing region during a breaking operation;

a buffer housing defining a pressurizing volume;

a nozzle arranged at a nozzle side of the pressurizing volume, the nozzle defining a channel connected to the pressurizing volume and directed to the arcing region, the nozzle configured to blow an arc extinguishing gas towards the arcing region during the breaking operation, the nozzle comprising a nozzle front face facing towards an interior of the pressurizing volume; and a shielding body arranged between the pressurizing volume and the nozzle, the shielding body being supported by the buffer housing, the shielding body having a shielding surface exposed to the interior of the pressurizing volume, the shielding body covering a major portion of the nozzle front face, the shielding body being supported by abutting against a stop of the buffer housing, and the stop the nozzle being sealed in axial direction, and the shielding body comprises an L-shaped cross-section comprising a long leg section perpendicular to the switching axis and a short leg section parallel to the switching axis, the shielding surface comprising:

an upper shielding surface defined by the long leg section;

a middle shielding surface defined by the short leg section, the middle shielding surface perpendicular to the upper shielding surface; and a lower shielding surface defined by the short leg section, the upper shielding surface, the middle shielding surface, and the lower shielding surface being exposed to the interior of the pressurizing volume.

* * * * *